US006574875B2

(12) United States Patent
Lawson et al.

(10) Patent No.: US 6,574,875 B2
(45) Date of Patent: Jun. 10, 2003

(54) PENCIL SHARPENER AND METHOD

(76) Inventors: Carroll Vernon Lawson, 2703 Merrimac, League City, TX (US) 77573; Hans P. U. Verswijver, 3009 Harvest Hill Dr., Friendswood, TX (US) 77546

( * ) Notice: Subject to any disclaimer, the term of this patent is extended or adjusted under 35 U.S.C. 154(b) by 0 days.

(21) Appl. No.: 09/885,150

(22) Filed: Jun. 20, 2001

(65) Prior Publication Data

US 2002/0005100 A1 Jan. 17, 2002

Related U.S. Application Data

(60) Provisional application No. 60/217,809, filed on Jul. 12, 2000.

(51) Int. Cl.[7] ..... B43L 23/06
(52) U.S. Cl. ..... 30/461
(58) Field of Search ..... 30/461, 454, 457–460, 30/462

(56) References Cited

U.S. PATENT DOCUMENTS

| | | | | |
|---|---|---|---|---|
| 969,323 A | * | 9/1910 | Anderson | 30/461 |
| 1,531,738 A | | 3/1925 | Davis | |
| 4,601,316 A | | 7/1986 | Verdi | |
| 5,894,669 A | | 4/1999 | Luttgens | |
| 5,957,602 A | | 9/1999 | Rosenthal | |
| D420,390 S | | 2/2000 | Donaldson | |

FOREIGN PATENT DOCUMENTS

| | | |
|---|---|---|
| SE | 116616 | 4/1946 |
| SE | 116617 | 4/1946 |

* cited by examiner

*Primary Examiner*—Douglas D. Watts
(74) *Attorney, Agent, or Firm*—Kenneth L. Nash

(57) ABSTRACT

The present invention is for an improved pencil sharpener that is slidingly disposed about a pencil. The pencil sharpener comprises a cutting surface, a first arm pivotally mounted or connected with respect to a second arm, and a pencil receiving variable-sized aperture formed through the interior of the first arm and the second arm. The variable-sized aperture preferably alters in size and/or shape depending on the pivotal position of the first arm with respect to the second arm. The pencil receiving variable-sized aperture preferably forms a substantially conical channel when the first arm and the second arm are compressed inwardly for sharpening the pencil. In another position of the arms, the variable sized aperture permits the pencil to slide through the pencil sharpener. A resilient means such as a grommet and/or spring-loaded surfaces on the arm is resiliently provided within the pencil sharpener for automatically mounting the pencil sharpener to the pencil such that the pencil supports and carries the pencil sharpener. The pencil sharpener is therefore available to sharpen the pencil whenever needed.

22 Claims, 9 Drawing Sheets

PENCIL SHARPENER AND METHOD

This Application claims benefit of Provisional No. 60/217,809 filed Jul. 12, 2000.

TECHNICAL FIELD

The present invention relates generally to an improved sharpener and, more specifically to an inexpensive pencil sharpener adapted to be carried by, and/or slidingly grip any standard non-mechanical pencil to be sharpened so as to be readily available for immediate use at any time.

BACKGROUND ART

Pencils have been around for centuries, and methods and apparatuses for sharpening pencils have been in the art for nearly as long as pencils themselves. Most non-mechanical pencils have a fungible outer core or sheath surrounding a graphite inner core. Alternatively, the inner core may be comprised of any material such as wax or the like that leaves a desired mark when pressure is applied.

One problem with non-mechanical pencils and their sharpeners is a frequent lack of availability of the sharpener when and as needed. In the prior art, sharpeners are separate from the pencil. Most often, modern sharpeners are stationary, having a base which is often designed to be more or less permanently mounted, or large units with a base such as a motorized sharpener. As such, these devices are not easily transported, and are kept apart from the pencil to be sharpened. Other smaller pencil sharpeners are non-mounted and are small enough to be easily carried but, due in some part to their small size, tend to be easily lost or forgotten and so are often not available when desired. It requires considerable user-diligence to continually carry around a small portable sharpener so that the sharpener is available when needed.

In the prior art, pencils are inserted with a sharpening mechanism which, as noted above, must first be located by the user prior to sharpening. One usual form of pencil sharpeners comprises a pair of cylindrical rollers having a plurality of helical cutting surfaces formed along the longitudinal periphery of each roller. The long axis of each roller is positioned at an angle with respect to a longitudinal sharpening axis about which the rollers both rotate in a manner such that each roller turns about its own axis counter-rotatively with respect to the other roller as both rollers rotate about the sharpening axis. A pencil inserted at a divergent open end of the inclined rollers has a point formed thereon as it is urged towards the converging end of the rollers. This type of sharpener typically requires mounting, is relatively expensive, and is not easily transported due to bulkiness.

Another usual form of pencil sharpeners has a cutting surface located at least partially exposed to in inner channel where the inner channel is adapted to receive a pencil or a tip of the pencil to be sharpened. For example U.S. Pat. No. D420,390 issued to Donaldson is typical.

Other prior art includes pencils with specially adapted sharpeners. U.S. Pat. No. 5,957,602 issued to Rosenthal is typical and discloses a wax pencil holding device formed from a main body. The main body is formed from first and second tubular portions. A thin wax pencil is adapted to be removably received within the first tubular portion of the main body. The wax pencil is dispensed and retracted via a sliding plunger. The wax pencil further includes a pencil sharpener with a frusto-conical inset portion. The pencil sharpener is removably coupled to the first end of the second tubular portion. A shaving container is included for storing the shavings of the wax pencil. The shaving container is adapted to be removably coupled to the second end of the pencil sharpener.

U.S. Pat. No. 5,894,669 issued to Luttgens is also illustrative. Luttgens '669 teaches a pencil sharpener for a soft core pencil that includes a sharpener housing defining a guide channel, adapted to receive a front region of the pencil therein and conically tapering in an insertion direction of the pencil, and a free space adjoining the guide channel in the insertion direction being adapted to receive a core tip of the pencil therein. The sharpener further includes a sharpener blade disposed within the housing and is positioned tangentially with respect to the guide channel, and a housing projection disposed in the housing and projecting into the free space and being configured for shaping the core tip of the pencil according to an intended shape. The housing projection comprises a shaving rib having an approximately wedge shaped cross section and projecting from the housing projection in an effective direction essentially tangential to a circumference of the core tip and being configured as a generator for the intended shape of the core tip.

Another common form of pencil sharpener is a motorized sharpener such as U.S. Pat. No. 4,601,316 issued to Verdi.

The prior art discussed above does not provide a readily available pencil sharpener that may be readily and easily clipped to and utilized with any pencil or other device which requires sharpening. Consequently, there remains a need to provide a low-cost, pencil sharpener that may be conveniently mounted and transferred to any pencil such that a pencil sharpener is always available.

SUMMARY OF THE INVENTION

Accordingly, it is an objective of the present invention to provide an improved pencil sharpener appropriate for non-mechanical pencils.

Another object of the present invention is an improved sharpener also suited for use as a stake sharpener or for sharpening other objects with adaptation to the desired size.

Yet another object of the present invention is a readily available, low cost sharpener that may be quickly and easily mounted to a pencil.

Accordingly, an improved pencil sharpener is described.

The present invention provides a pencil sharpener slidably mountable to a pencil and preferably comprises elements such as, for instance, a first arm adapted to receive a cutting blade, a second arm pivotally mounted with respect to the first arm, the first arm and the second arm defining there between an aperture for receiving the pencil, a biasing member for biasing the first arm pivotally outwardly with respect to the second arm, and stop members to limit the pivotally outwardly movement of the first arm with respect to second arm.

In one embodiment, the pencil sharpener may comprise a pencil bounding surface defined between the first arm and the second arm when the first arm and the second arm are compressed for pivotally inwardly movement with respect to each other, the pencil bounding surface engaging the end of the pencil to be sharpened thereby providing a boundary for limiting axial movement of the pencil with respect to the cutting blade during sharpening of the pencil.

Other elements may include stop members to limit the pivotally inwardly movement of the first arm with respect to the second arm and/or a housing whereby the first arm and the second arm being pivotally mounted within the housing for pivotal movement with respect to the housing. The first arm and/or second arm may define a channel therein for receiving cuttings produced during sharpening of the pencil.

Additional elements may include an axial position gripping surface such that the axial position gripping surface is engageable with the pencil for affixing the pencil to an axial position at any position along an axial length of the pencil. In one embodiment the axial position gripping surface comprises a grommet and/or a first interior surface of the first arm and a second interior surface of the second arm whereby the biasing member urges the first interior surface and the second interior surface into engagement with the pencil.

In operation, the pencil sharpener provides a method which may include steps such as, for instance, inserting a pencil into the pencil aperture, axially sliding the pencil sharpener along an axial length of the pencil to any position along the axial length of the pencil, and resiliently affixing the pencil sharpener at the axial position along the axial length of the pencil sharpener.

Other method steps may comprise axially sliding the improved pencil sharpener along the pencil from the axial position to a position proximate a pencil tip to be sharpened, bringing a cutting edge of the pencil sharpener into contact with the pencil tip, rotating the pencil tip until a desired cut is achieved axially sliding the pencil sharpener back along the pencil, and automatically affixing the pencil sharpener to the pencil. In a preferred embodiment, the method may comprise bringing a cutting edge of the pencil sharpener into contact with the pencil tip by compressing the plurality of arms. The step of resiliently affixing may comprise compressing a grommet.

A method of making a pencil sharpener in accord with the present invention may comprise steps such as, for instance, pivotally interconnecting a plurality of arms such that the arms are pivotal inwardly and outwardly with respect to each other, providing a pencil receiving aperture through the plurality arms with a variable-sized opening therethrough, the variable size opening varying in size due to movement of the plurality of arms pivotally inwardly and outwardly, and mounting a cutting blade to at least one of the plurality of arms.

Other steps may include providing that an interior surface of the plurality arms form a conical surface for engaging a pencil tip end of the pencil when the plurality of arms are moved pivotally inwardly with respect to each other and/or biasing the plurality of arms pivotally outwardly with respect to each other and/or mounting the plurality of arms in a housing and/or mounting a grommet within the pencil receiving aperture whereby the grommet has an internal diameter sized to support the pencil sharpener on a pencil by engaging a pencil with a surface of the grommet. In a preferred embodiment, steps may include providing a pivotal connection at an end of each of the plurality of arms and/or forming a radially extending aperture through at least one of the arms to provide an outlet for cuttings formed during sharpening of the pencil.

Thus, an improved pencil sharpener is provided for sliding disposal about a pencil. The pencil sharpener may comprise in one preferred embodiment one or more of the following elements such as a cutting surface, a first arm having a first end, a second end, a top end, a bottom end, a first side having a first pivot disposed outwardly near the second end, and a second side having a second pivot disposed outwardly near the second end, the bottom end having a substantially semi-frusto-conical channel therethrough, the first arm further adapted to receive the cutting blade, and a second arm having a first end, a second end, a top end, a bottom end, a first side having an aperture disposed near the second end for accepting the first pivot, and a second side having an aperture disposed near the second end for accepting the second pivot, the top end having a substantially semi-frusto-conical channel therethrough, wherein the pivot may be disposed within the pivot channel of the first arm and the pivot channel of the second arm, whereby the first arm pivots with respect to the second arm into a first open position and second closed posit-ion, the semi-frusto-conical channel of the first arm and the semi-frusto-conical channel of the second arm form a substantially frusto-conical channel and a substantially cylindrical channel in the second closed position, whereby the pencil sharpener accepts the pencil therethrough and remains substantially stationary about the pencil in the first open position and slidingly engages the pencil in the second closed position and/or the cutting surface engages the pencil in the second closed position and does not engage the pencil in the first open position.

BRIEF DESCRIPTION OF DRAWINGS

For at further understanding of the nature and objects of the present invention, reference should be had to the following detailed description, taken in conjunction with the accompanying drawings, in which like elements are given the same or analogous reference numbers and wherein.

GENERAL DESCRIPTION AND PREFERRED MODES FOR CARRYING OUT THE INVENTION

Figure 1:
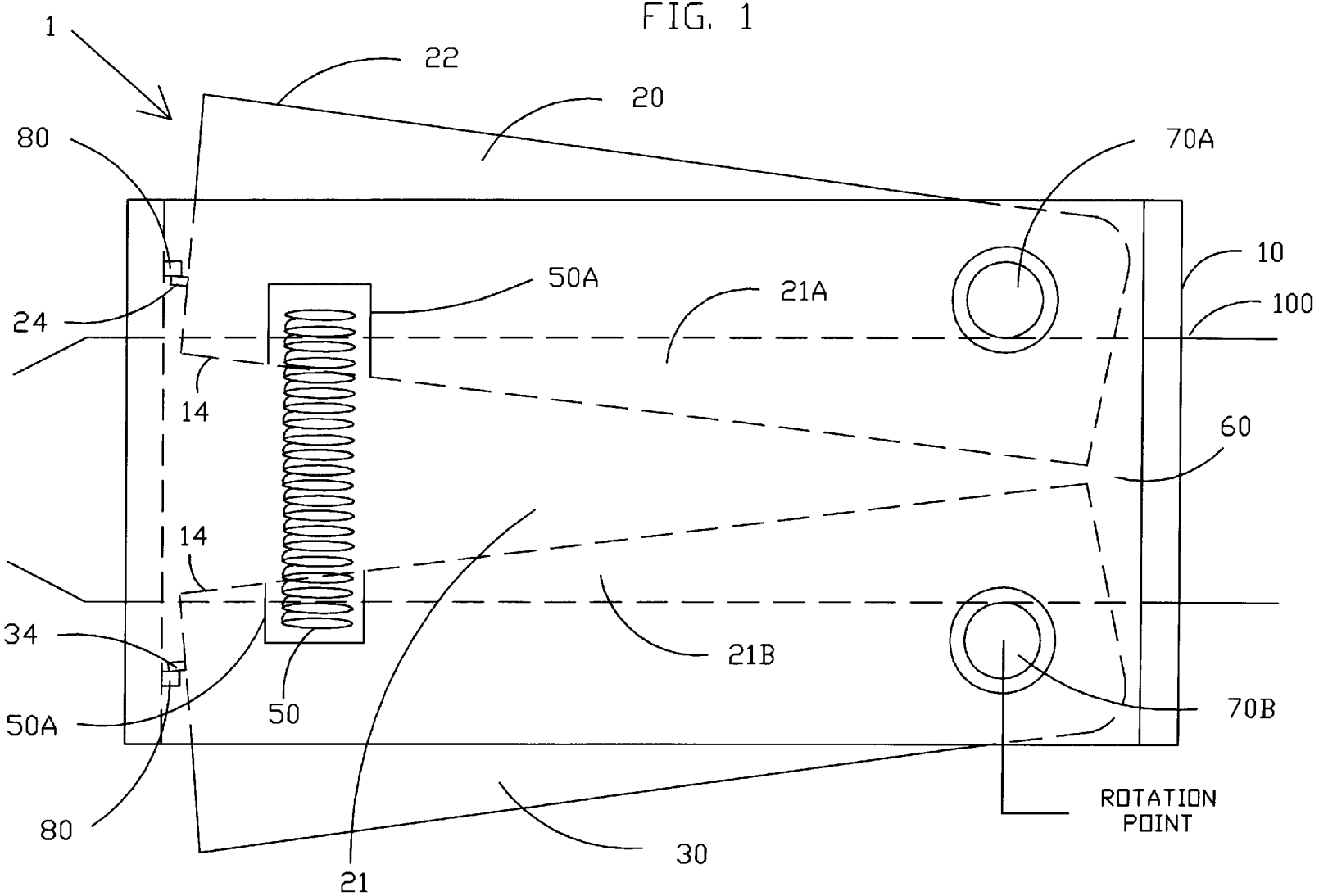
FIG. 1 is an elevational side view, partially in phantom lines, of the present invention in a non-cutting position.

Referring now to the drawings, and more particularly to FIG. 1, there is shown an elevational side view of sharpener 1 of the present invention in a non-cutting, carrying or transporting position which may be utilized for sharpening various objects but which is especially suitable for use in conveniently sharpening pencils. Sharpener 1 is adapted to have pencil 100 inserted through improved pencil sharper 1. Pencil sharpener 1 has two basic operating positions. The first position (shown in FIG. 1) is a non-cutting position in which the cutting surface, discussed subsequently, is disengaged from pencil 100 and will not cut pencil 100. The second position (shown in FIG. 2) is a cutting position in which the cutting surface engages pencil 100 to cut an end of pencil 100. As used herein, "pencil" and "writing" are understood to mean and include hand-held or machine-held instruments which can be sharpened to create an instrument usable for writing, drawing, coloring, marking, or the like. This includes instruments with fungible outer shells and internal writing cores such as standard pencils, instruments with or without disposable or fungible outer shells such as crayons, and the like. As used herein, "pencil" and "writing" also includes materials which can be sharpened to create a pointed end such as stakes which may be used for securing tents and the like.

In FIG. 1, which shows a currently preferred embodiment of the invention, outer shell 10 houses and/or supports first arm 20 and second arm 30. In this embodiment, first arm 20 pivots within outer shell 10 at pivot 70A. Pivot 70A may be molded or otherwise formed as part of outer shell 10 or may comprise a separate pivot piece extending through a side of outer shell 10 into first arm 20 and out through the opposing side of outer shell 10. Similarly, second arm 30 pivots within outer shell 10 at pivot 70B. Pivot 70B may also be molded or otherwise formed as part of outer shell 10 or may comprise a separate pivot piece extending through a side of outer shell 10 into second arm 30 and out through the opposing side of outer shell 10.

Figure 7:
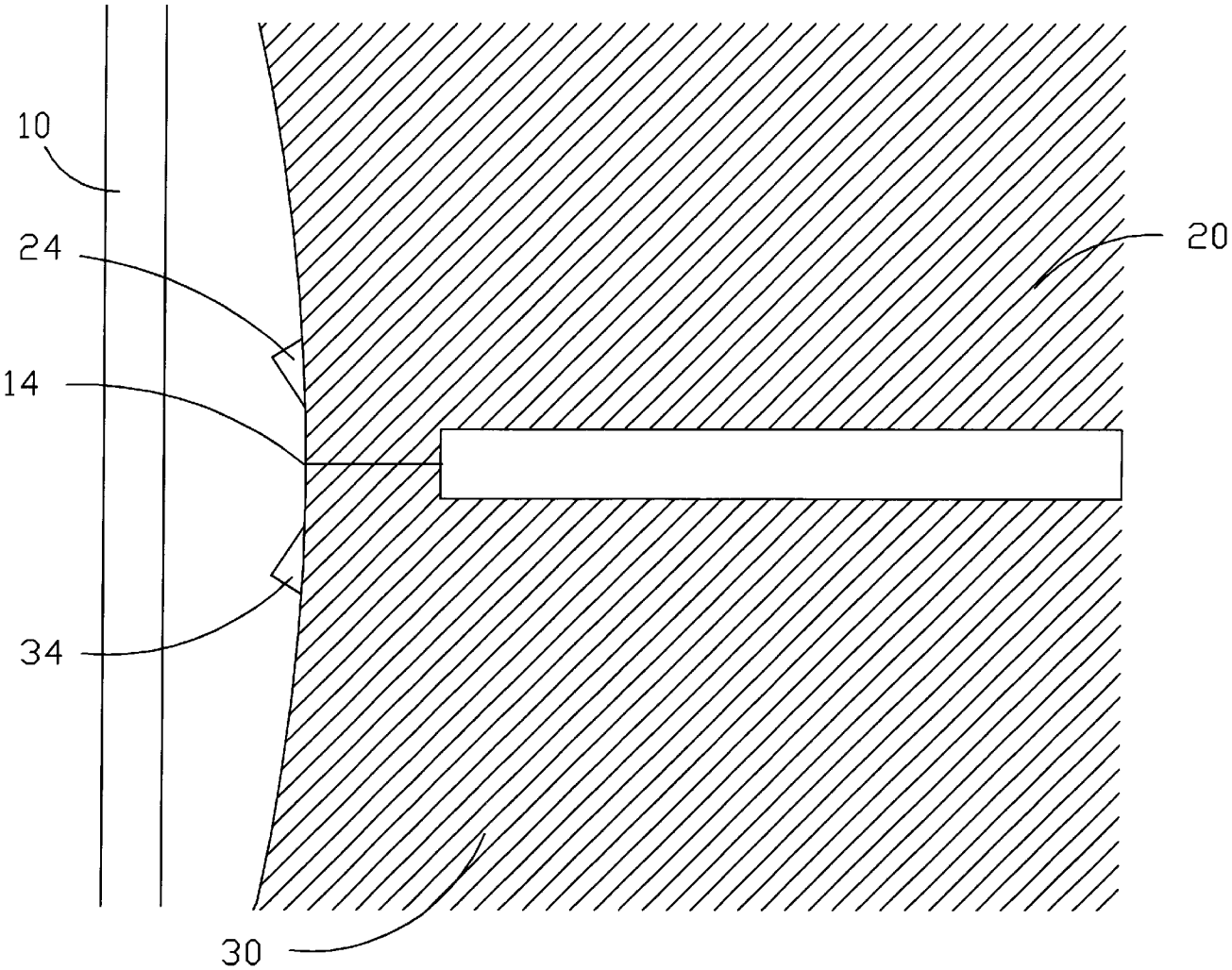
FIG. 7 is an enlarged elevational view, partially in cross-section, showing travel stops for the moveable cutting arms of the present invention.
Figure 8A:
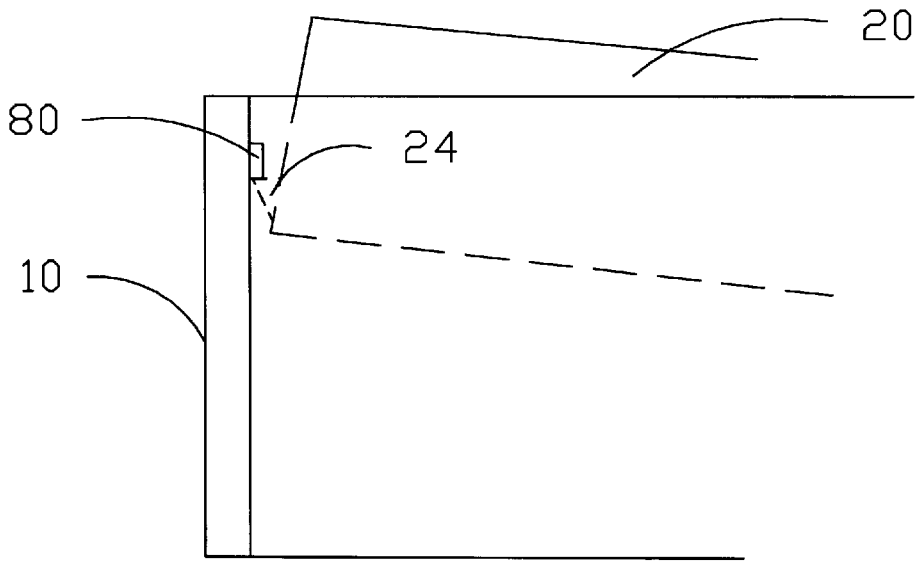
FIG. 8*a* is an elevational view, partially in phantom lines, showing travel stops for the moveable cutting arms of the present invention.
Figure 8B:
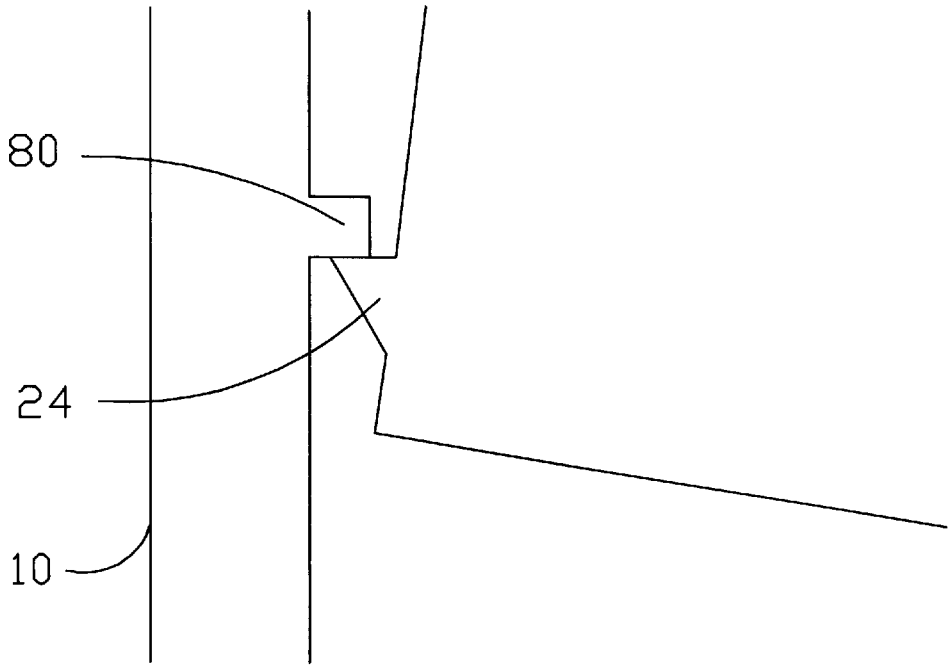
FIG. 8*b* is an enlarged elevational view showing a close-up of a travel stop for the moveable cutting arms in accord with the present invention.

In the embodiment of FIG. 1, and as also illustrated in a magnified view in FIG. 7, FIG. 8A, and FIG. 8B, travel limiter or stop surface 80 limits travel or pivotal movement of first arm 20 by engaging against first arm stop 24 and likewise limits travel or pivotal movement of second arm 30 by engaging against second arm stop 34. Travel limiter 80 may be a shoulder, an extended portion, an inset piece, notch, groove, recess, or any other suitable construction to provide a stop surface. Accordingly, first arm stop 24 and second arm stop 34 may be a shoulder, an extended portion, an inset piece, or any other suitable construction for engaging travel limiter or stop surface 80. FIG. 7 shows first arm 20 and second arm 30 engaged with each other at stop surfaces 14 in the cutting position with stop 24 and stop 34 spaced with respect to each other. FIG. 8A shows arm 20 in the open position whereby stop surface 24 engages stop surface 80. FIG. 8B shows an enlargement of stop surface 24 engaging stop surface 80. However any means for limiting movement may be utilized. For instance straps are discussed below for use in another embodiment for limiting outwardly pivotal movement. Slot and pin mechanisms, grooves and guide members, and other means may be utilized to limit movement.

In one possible alternative embodiment to that shown in FIG. 1, first arm 20 may be directly mounted to second arm 30 to thereby pivot with respect to second arm 30. In this alternative embodiment, a portion of first arm 20 is aligned near a portion of second arm 30 and a pivot element, such as for instance a single pivot point or some other pivotal element, is inserted or interconnected with first arm 20 and second arm 30 through the pivot point. Thus, instead of separate pivots for each arm, a single pivot point might be utilized. As discussed above the pivot could have other constructions such as a molded construction or the like.

In yet a further alternative embodiment, first arm 20 may be pivotally mounted to second arm 30 without requiring outer shell 10. In this embodiment, a pivot connection may be formed integrally with first arm 20. Second arm 30 may then be aligned with first arm 20, and the integral pivot connection may be inserted therethrough. The pivot element could also be part of either arm with the other arm mounted thereto so as to pivotally connect first arm 20 and second arm 30.

Spring 50 may be disposed within socket 50A intermediate first arm 20 and second arm 30 to provide a biasing force to spread first arm 20 with respect to second arm 30. Alternatively, other spring means may be used such as a leaf spring disposed intermediate first arm 20 and second arm 30. Thus, a biasing member such as spring 50, biases arm 20 pivotally away from arm 30 until housing stop surfaces 80 prevent further outwardly pivotal movement by engagement with respective arm stop surfaces 24 and 34.

Figure 1B:
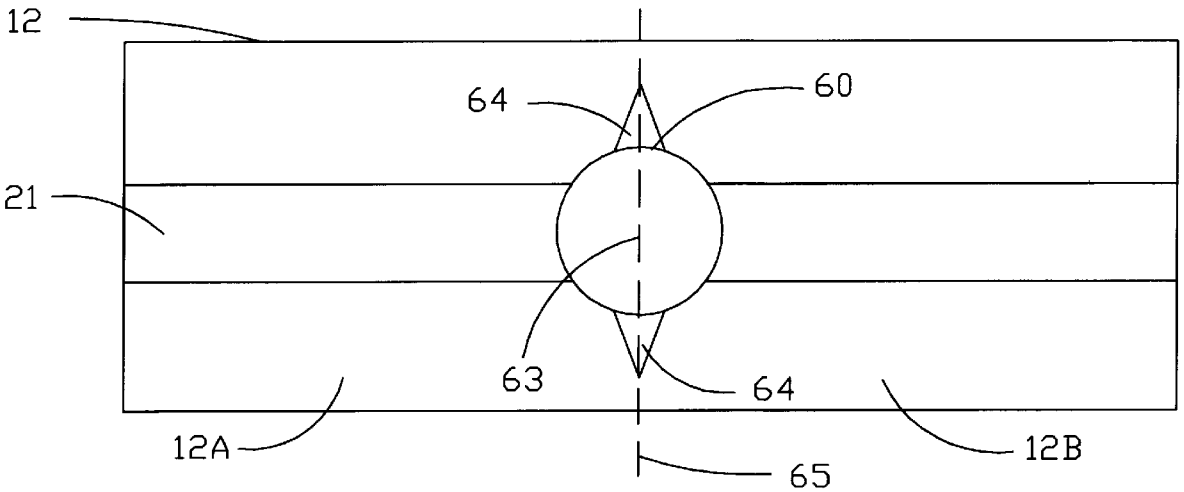
FIG. 1B is a top view of one possible embodiment of a one-piece construction of the present invention comprised of resilient material.
Figure 1C:
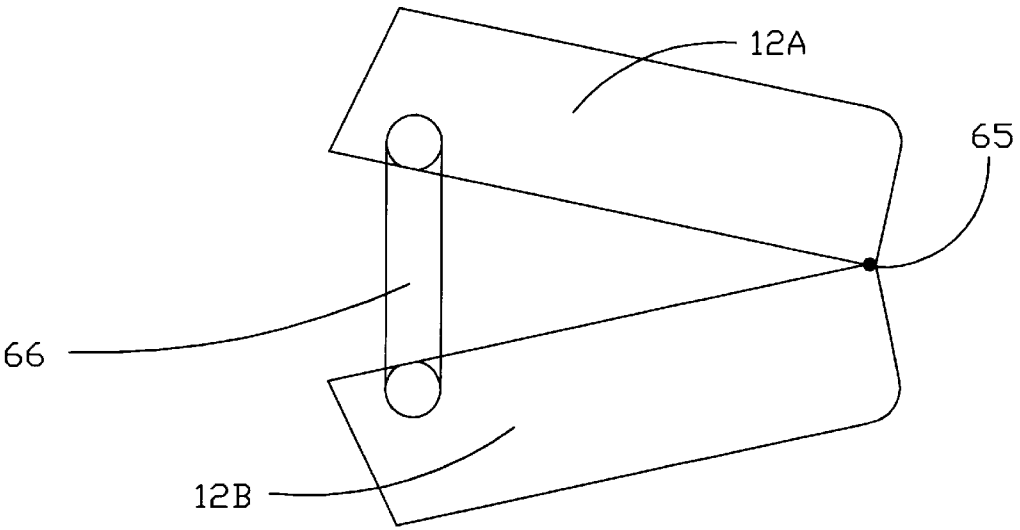
FIG. 1C is a side view of the embodiment of FIG. 1B folded over to form a sharpener in accord with the present invention.

Referring now to FIG. 1B and FIG. 1C, a further alternative embodiment of the present invention is disclosed which permits a low-cost construction sharpener comprised of resilient material which is folded over to thereby produce a biasing force between first arm 12A and second arm 12B. Single flexible holder 12 may have channel 21 extending the length of holder 12 with pencil aperture 60 disposed at center point 63. Pencil aperture 60 extends through holder 12. A cutting surface is disposed within channel 21 or within holder 12 with at least a portion of cutting surface being exposed within channel 21.

Holder 12 is pivoted about center axis 65. Center axis 65 appears as a pivot point or line from the side view of FIG. 1C. Notches 64 in a V-shape or similar shape may be provided along center axis 65 to facilitate folding and pivoting about a selected center axis 65. When folded over and pivoted as shown in FIG. 1C, sharpener 12 forms first arm 12A and second arm 12B. One or more restraints 66 may be present to keep sharpener 12 in the first non-cutting position. Restraints 66 may comprise straps, springs such as spring 50, bands, or any combination thereof. Spring 50 may also be present in this embodiment, such as a coil or leaf spring, to bias holder 12 into the open position to either enhance the operation of resilient material in making the folded-over embodiment of FIG. 1C, or to eliminate the need for using resilient material in making the folded-over embodiment of FIG. 1C such that non-resilient and simply pliable/foldable materials can be utilized in the folded-over embodiment of FIG. 1C.

Thus, in its various embodiments some of which are discussed above, improved pencil sharpener 1 is adapted to allow pencil 100 to be inserted through pencil aperture 60. When in the first open position as shown in FIG. 1, pencil sharpener 1 may be engaged in an interference fit position about pencil 100 to thereby axially affix sharpener 1 to pencil 100. In one embodiment, spring 50 is used to provide a biasing force to enable the pivotal ends of arms 20 and 30 to engage pencil 100 to produce the interference fit such that pencil sharpener 1 is mounted to a particular position along the length of pencil 100. Thus, a user can, in a preferred embodiment, position pencil sharpener 1 at any axial position along the length of pencil 100 and sharpener 1 is thereby automatically affixed to that point for carrying, mounting, and so forth without concern of sharpener 1 inadvertently sliding off pencil 100. When arms 20 and 30 are moved to an intermediate position the interference grip is released allowing improved pencil sharpener to slide about pencil 100 into a desired position about pencil 100. However, even with arms 20 and 30 biased, as indicated in FIG. 1, such that ends of arms 20 and 30 engage pencil 100 in an interference fit, the biasing force is such that pencil 1 may typically be easily slid along the pencil. Some gripping friction is encountered as discussed above and, accordingly, the gripping friction affixes pencil 100 at some user-desired axial position.

Figure 2:
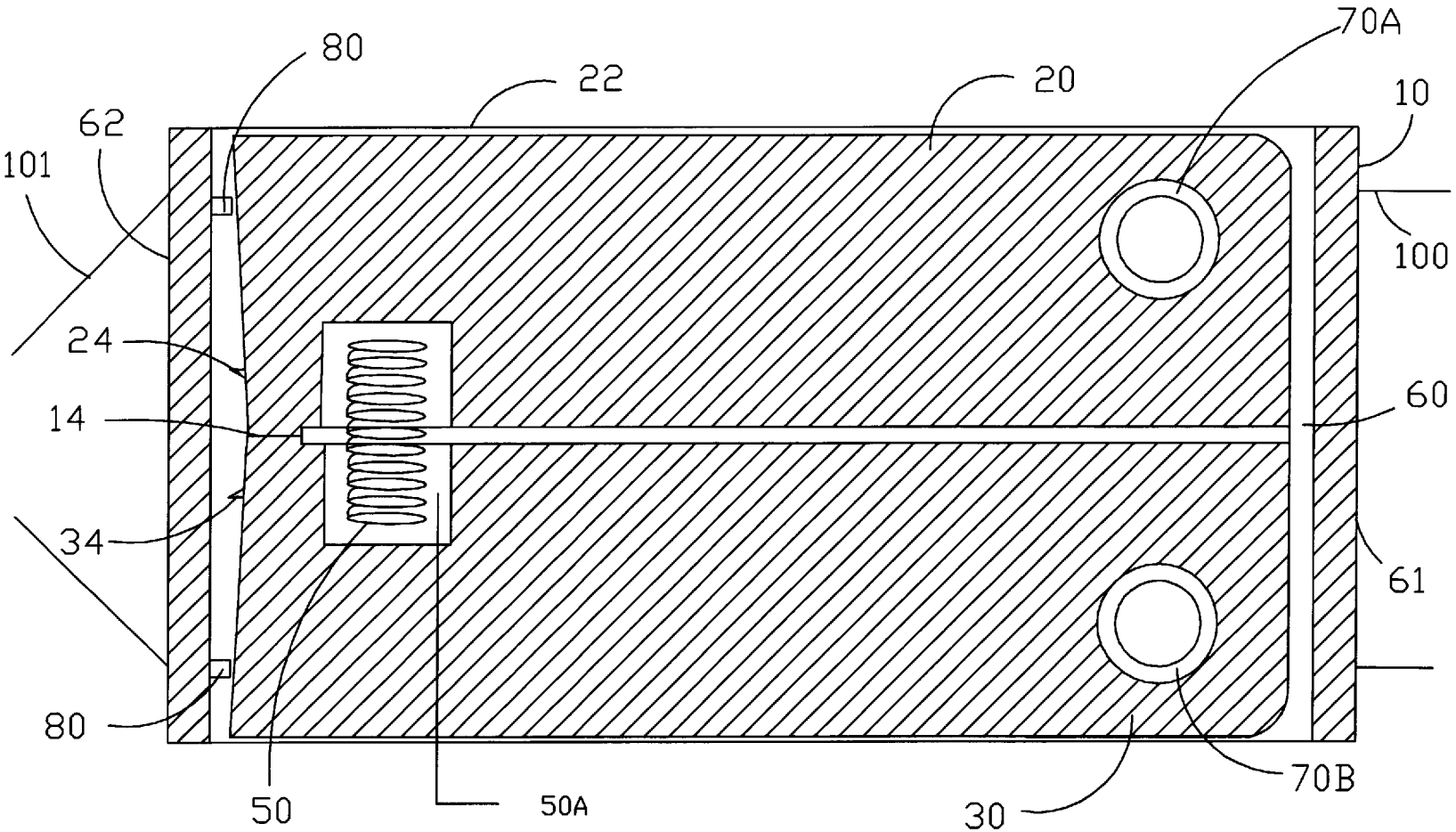
FIG. 2 is an elevational side view along lines 2—2 of FIG. 4, partially in cross-section, of the present invention in a cutting position.

In an alternative embodiment, grommet 61, shown in FIG. 2, is disposed about second end 60 to provide by itself or in conjunction with spring 50 a biasing force to grip pencil 100 for axially affixing sharpener 1 to pencil 100 at any axial position along pencil 100 when sharpener 100 is not needed. Grommet 61 provides a flexible loop of any elastic material that serves as a fastening or support to engage pencil 100 for fastening or supporting sharpener 1 with respect to pencil 100. Thus, grommet 61 is sized to provide a friction grip of pencil 100. Of course, sharpener 1 can also be removed from pencil 100 and positioned on another pencil as desired by the user. In the presently preferred embodiment, in first non-cutting position pencil aperture 60 is therefore adapted to secure improved pencil sharpener 1 against pencil 100. Grommet 61 may be integral with or secured within pencil aperture 60 to provide additional interference fit. Grommet 61 may be formed of any appropriate semi-elastic or elastic material such as plastic, rubber, or the like.

Figure 3:
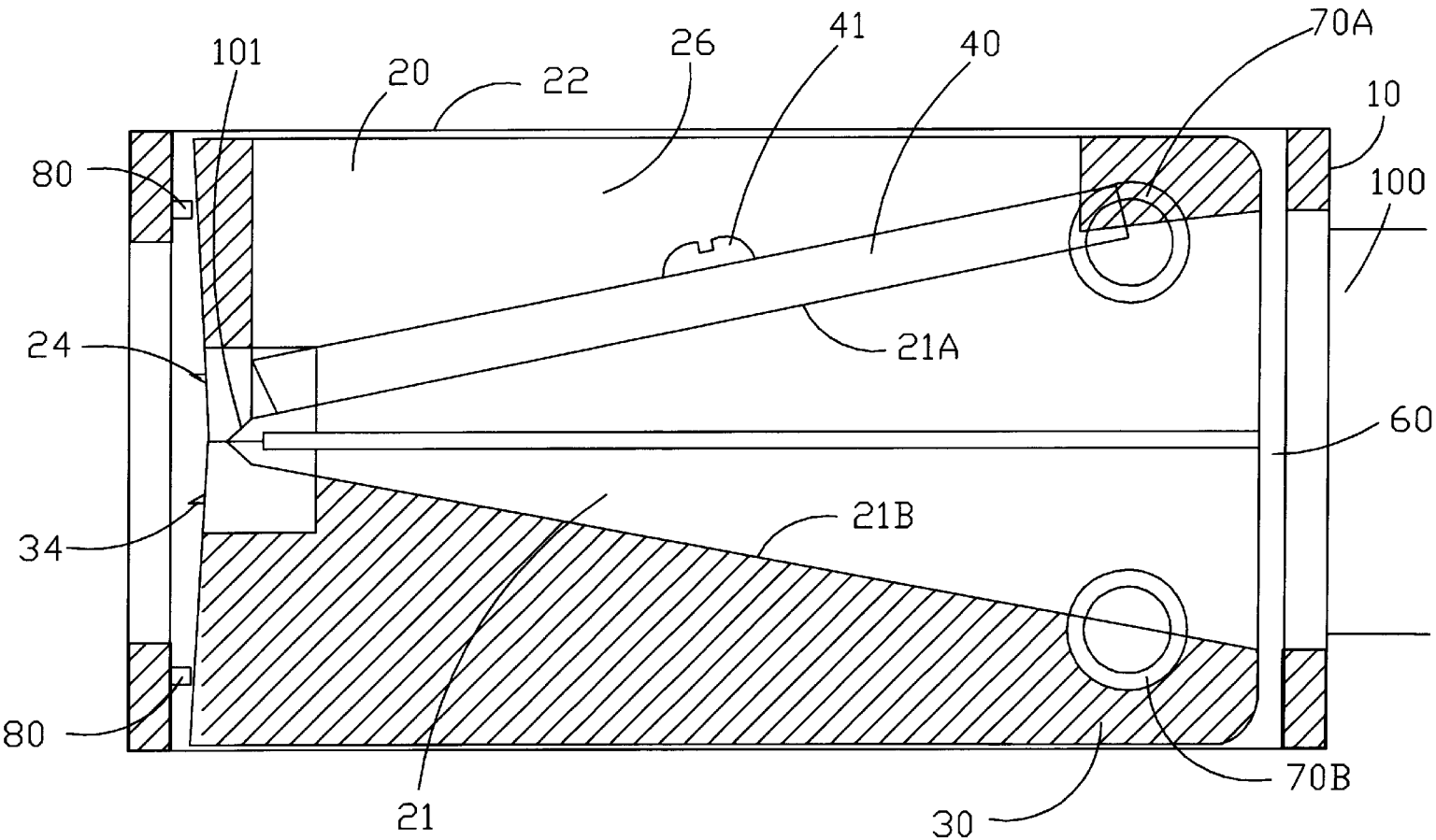
FIG. 3 is an elevational view along lines 3—3 of FIG. 4, partially in cross-section, of the present invention in a cutting position.

Referring now to FIG. 2 and FIG. 3, which each show a respective cross-sectional side view of the present invention in its second cutting position, improved pencil sharpener 1 has been positioned near tip end 101 of pencil 100. When in the cutting position, improved pencil sharpener 1 encases pencil 100 such that a cutting surface 40, shown in FIG. 3, is in cutting contact with pencil tip 101. Finger pressure may be conveniently applied to the ends of first arm 20 and second arm 30 distal to pivot point 70A and 70B, to thereby close or compress first arm 20 with respect to second arm 30, thereby engaging cutting surface 40 against pencil 100 as stop surfaces 14 engage to prevent further compressing movement at a predetermined desired cutting angle for the point of pencil 100. Pencil 100 and sharpener 1 may then be rotated with respect to each other to effect sharpening. Cuttings may then exit through an external side of either first arm 20 or second arm 30 such as through cuttings channel 26 in first arm 20 shown in FIG. 3, which provides an aperture through top end 22 when cutting surface 40 is disposed within first arm 20.

When closing pressure such as finger pressure is removed, then spring 50 may bias first arm 20 and second arm 30 to pivot away from each other and back into the open position whereupon stop surfaces 80 engage respective stop surfaces 24 and 34 to prevent further outwardly pivotal movement of arm 20 relative to arm 30.

Figure 3A:
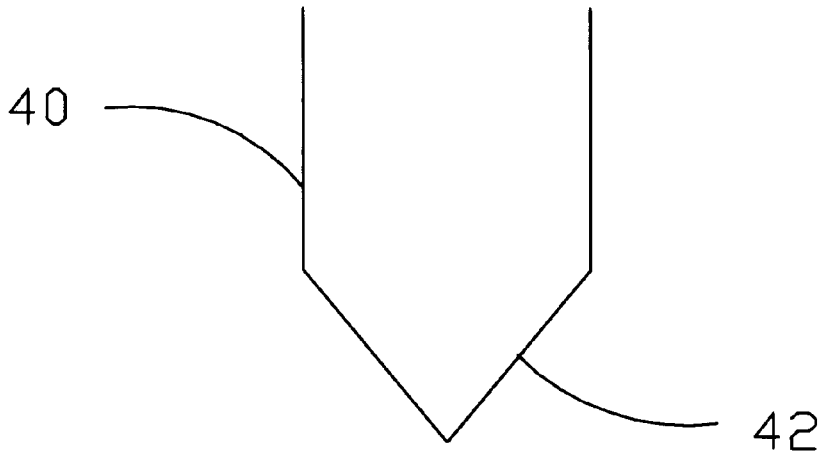
FIG. 3*a* is a side view of a double chisel point cutter in accord with the present invention.
Figure 3B:
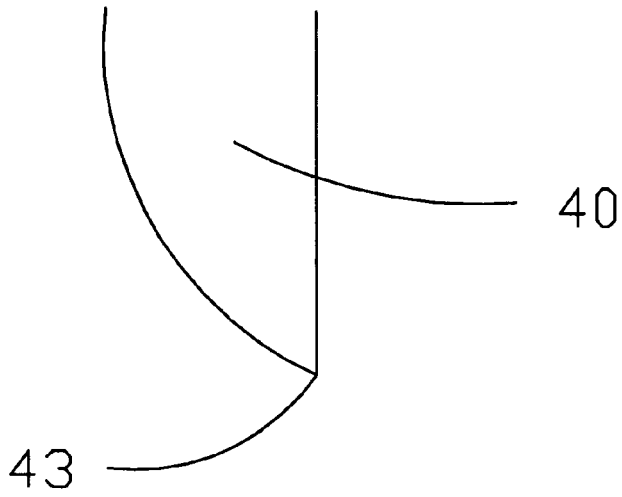
FIG. 3*b* is a side view of a single chisel point cutter in accord with the present invention.

FIG. 3, provides another elevational view with a different cross-section of the second closed position with cutting surface 40 engaged against pencil tip 101. In the presently preferred embodiment, cutting surface 40 may be a metal cutter with a sharpened edge as is well understood by those skilled in the cutting surfaces art and may be secured within an arm such as first arm 20 by screw 41. Cutting surface 40 may have any appropriate cutting profile such as double chisel point 42 shown in FIG. 3A or single chisel point 43 shown in FIG. 3B or any other suitable configuration. Alternatively, cutting surface 40 may be separately formed and then integrated into first arm 20 by any means such as are well understood by those in the injection molding or casting arts. In a further alternative embodiment, cutting surface 40 may be integrally formed as part of first arm 20 or second arm 30 or both such as by a sufficiently hardened plastic or metal. As discussed above, cuttings or shavings produced by engaging and rotating pencil 100 with respect to cutting surface 40 may exit cuttings channel 26.

When in its cutting position, pencil channel 21 is preferably substantially conical or frustoconical and provides a stop end for pencil 100 such that pencil 100 may engage with and rotate in the same general axial position with respect to sharpener 1 during sharpening. Thus, in a preferred embodiment, pencil channel 21 is shaped to match to the typically conical shape of the sharpened end of the pencil to thereby provide a stop surface during sharpening. Other internal shapes could also be used so long as the function of forming a stop surface is provided that provides a stop while simultaneously allowing sharpening of the pencil. The axial position of pencil 100 with respect to sharpener 1 will vary somewhat as cuttings are removed. When in an intermediate position between the cutting position and the non-cutting affixed position, pencil channel 21 may be partially or substantially cylindrical and permit easy axial movement of pencil 100 with respect to sharpener 1. In any event, aperture 60 is opened up in this position to permit axial sliding of pencil 100 with respect to sharpener 1. Thus, pencil aperture 21 is variable in shape and/or size. Pencil aperture 21 is formed within sharpener 1 by first pencil internal semicircular channel surface 21A of first arm 20 and second pencil internal semi-circular channel surface 21B of second arm 30. As first arm 20 and second arm 30 are pivoted, the relative positions of the internal surfaces 21A and 21B changes thereby changing the size and/or shape or profile of aperture 60.

Figure 4:
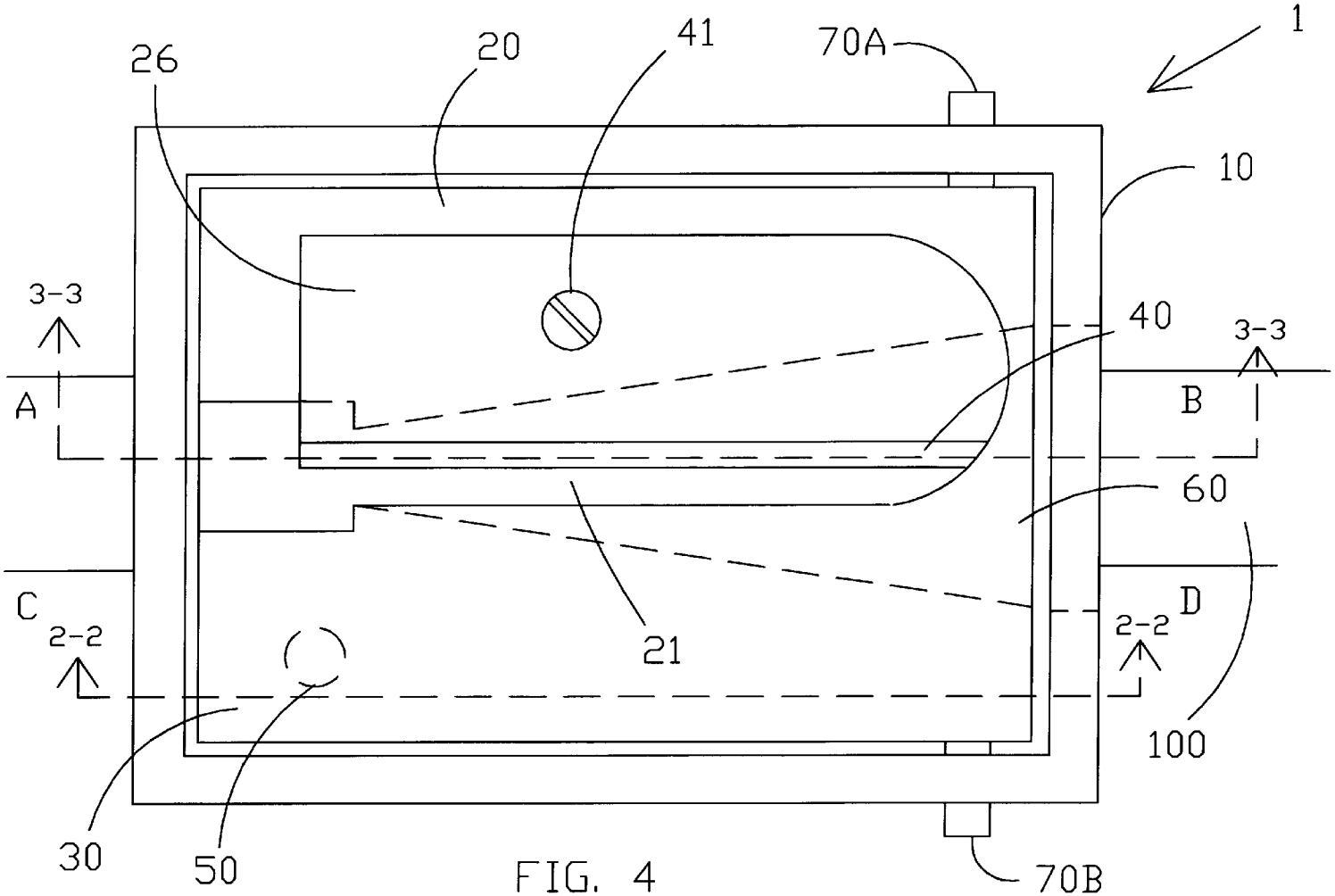
FIG. 4 is an elevational view, partially in phantom lines, of a top portion of an embodiment of a pencil sharpener in accord with the present invention.

Referring now to FIG. 4, a top view of improved pencil sharpener, in the presently preferred embodiment cutting surface 40 is disposed within first arm 20 and aligned within a first portion of first arm 20. When in closed second position, pencil 100 is rotated against an engaging edge of cutting surface 40, and cuttings exit cuttings channel 26.

Figure 5:
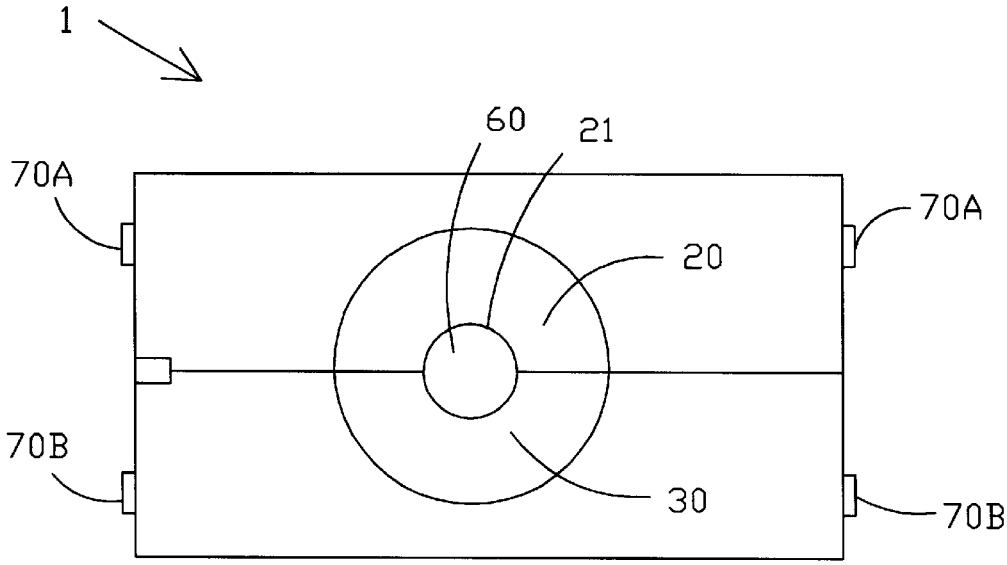
FIG. 5 is an elevational view of a second end of an embodiment of the invention showing a pencil aperture.
Figure 6:
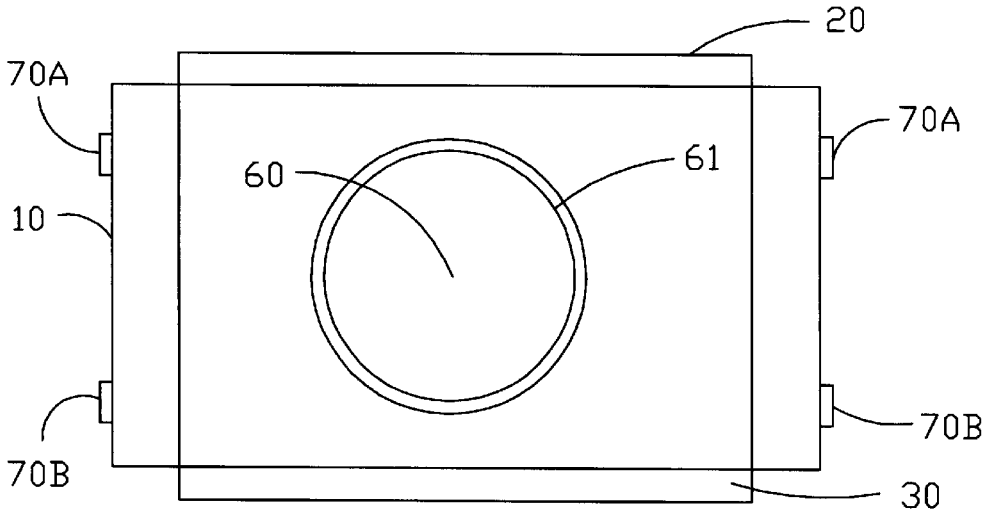
FIG. 6 is an elevational view of an alternative embodiment of the second end of the invention.

Referring now to FIG. 5, an elevational view of the pencil point end of sharpener 1 is shown with pencil sharpener 1 compressed into a cutting position without the pencil to view into sharpener 1. The end of channel 21 forms a circular aperture through which the pencil point may extend. In a presently preferred embodiment, pencil sharpener 1 is slidingly disposed about pencil 100 and secured against pencil 100 when in first non-cutting position by interference fit against pencil 100. Pencil channel 21, see FIG. 1, is formed by first pencil semi-channel 21A of first arm 20 and second pencil semi-channel 21B of second arm 30. In an intermediate position between the non-cutting position and the cutting position, channel 21 may be substantially cylindrical to allow improved pencil sharpener 1 to slide about pencil 100 unimpeded, if desired. However, if the biasing force is relatively easy to overcome, as may typically be employed, then sharpener 1 may be easily axially moved by the user while still providing a relatively secure grip on pencil 100 when not in use. In the compressed cutting position, pencil 100 may freely rotate within conical channel 21 whereby the pencil point engages the conical or frustoconical surface of channel 21 as well as cutter blade 40. FIG. 6 discloses pencil point end of sharpener 1 with arms 20 and 30 in an intermediate position such that grommet 61 may be visible, depending on the relative size thereof, if pencil 100 is not within aperture 60.

In the operation of the preferred embodiment, improved pencil sharpener 1 is biased into its second cutting position by biasing pressure such as finger pressure and pencil 100 inserted at pencil aperture 60. In the intermediate position of arms 20 and 30 between compressed and open positions, improved pencil sharpener 1 may be easily slid along pencil 100 into its desired position. Biasing pressure is then released and improved pencil sharpener 1 is biased into interference fit against pencil 100 such as by spring 50. Grommet 61 may also be utilized for axially affixing pencil 100 with respect to pencil sharpener 1.

Pencil 100 is then used in normal manner with sharpener 1 attached thereto until it is desired to sharpen pencil 100. At that time, improved pencil sharpener 1 may again be biased into its intermediate position by biasing pressure such as finger pressure and/or slid along pencil 100 until it reaches a desired position proximate tip 101. Further biasing pressure brings cutting edge 42 of cutting surface 40 into contact with tip 101 and pencil 100 rotated until the desired tip is achieved. Improved pencil sharpener 1 is then slid back along pencil 100 into its desired position and biasing pressure released. If desired, pencil sharpener may be removed from one pencil and positioned on another pencil.

It may be seen from the preceding description that an improved pencil sharpener has been provided.

It is noted that the embodiment of the improved pencil sharpener described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pencil sharpener for slidably mounting about a pencil, said pencil having an end for sharpening, said pencil sharpener comprising:

a first arm;

a second arm pivotally mounted with respect to said first arm to permit pivotally inwardly movement of said first arm with respect to said second arm and pivotally outwardly movement of said first arm with respect to said second arm, said first arm and said second arm defining therebetween an aperture for receiving said pencil;

a cutting blade joined to at least one of said first arm or said second arm;

at least one of said first and second arms defining a second aperture for mounting said pencil sharpener at any position along an axial length of said pencil; and outwardly movement stop members to limit said pivotally outwardly movement of said first arm with respect to said second arm.

2. The pencil sharpener of claim 1, further comprising:

a pencil bounding surface defined between said first arm and said second arm when said first arm and said second arm are compressed for pivotally inwardly movement with respect to each other, said pencil bounding surface engaging said end of said pencil to be sharpened thereby providing a boundary for limiting axial movement of said pencil with respect to said cuffing blade during sharpening of said pencil.

3. The pencil sharpener of claim 2, further comprising:

inwardly movement stop members to limit said pivotally inwardly movement of said first arm with respect to said second arm.

4. The pencil sharpener of claim 1, further comprising:

a housing, said first arm and said second arm being pivotally mounted within said housing for pivotal movement with respect to said housing.

5. The pencil sharpener of claim 1, wherein said first arm defines a channel therein for receiving cuttings during sharpening of said pencil.

6. The pencil sharpener of claim 1, further comprising:

an axial position gripping surface, said axial position gripping surface being engageable with said pencil for affixing said pencil sharpener to an axial position at any position along an axial length of said pencil.

7. The pencil sharpener of claim 6, wherein said axial position gripping surface comprises a grommet.

8. The pencil sharpener of claim 1, further comprising a biasing member mounted between said first arm and said second arm.

9. A method for making a pencil sharpener for a pencil, said pencil having a pencil tip end, said method comprising:

pivotally interconnecting a plurality of arms such that at least one of said arms is pivotal inwardly and outwardly with respect to the other;

providing a pencil receiving aperture through said plurality of arms with a variable sized opening extending therethrough for mounting said pencil sharpener to an axial position at any position along an axial length of said pencil, said variable size opening varying in size due to movement of said plurality of arms pivotally inwardly and outwardly; and mounting a cutting blade to at least one of said plurality of arms.

10. The method of claim 9, further comprising:

providing that an interior surface of said plurality arms form a conical surface for engaging a pencil tip end of said pencil when said plurality of arms are moved pivotally inwardly with respect to each other.

11. The method of claim 9, further comprising:

biasing said plurality of arms pivotally outwardly with respect to each other.

12. The method of claim 9, further comprising:

mounting said plurality of arms in a housing.

13. The method of claim 9, further comprising:

mounting a grommet within said pencil receiving aperture, said grommet having an internal diameter sized to support said pencil sharpener on a pencil by engaging a pencil with a surface of said grommet.

14. The method of claim 9, further comprising:

providing a pivotal connection an end of each of said plurality of arms.

15. The method of claim 9, further comprising:

forming a radially extending aperture through at least one of said arms to provide an outlet for cuttings formed during sharpening of said pencil.

16. The method of claim 9, further comprising:

forming a gripping surface on said plurality of arms for gripping said pencil when said plurality of arms are moved pivotally away from each other to support said pencil sharpener in an axial position along a length of said pencil.

17. A pencil sharpener for slidably mounting about a pencil, said pencil having an end for sharpening, said pencil sharpener comprising:

a first arm adapted to receive a cutting blade and defining a channel therein for receiving cuttings during sharpening of said pencil;

a second arm pivotally mounted with respect to said first arm to permit pivotally inwardly movement of said first arm with respect to said second arm and pivotally outwardly movement of said first arm with respect to said second arm, said first arm and said second arm defining therebetween an aperture for receiving said pencil; and outwardly movement stop members to limit said pivotally outwardly movement of said first arm with respect to said second arm.

18. A method for making a pencil sharpener for a pencil, said pencil having a pencil tip end, said method comprising:

pivotally interconnecting a plurality of arms such that said arms are pivotal inwardly and outwardly with respect to each other;

providing a pencil receiving aperture through said plurality of arms with a variable sized opening therethrough, said variable size opening varying in size due to movement of said plurality of arms pivotally inwardly and outwardly;

mounting a cutting blade to at least one of said plurality of arms; and mounting a grommet within said pencil receiving aperture, said grommet having an internal diameter sized to support said pencil sharpener on a pencil by engaging a pencil with a surface of said grommet.

19. A method for making a pencil sharpener for a pencil, said pencil having a pencil tip end, said method comprising:

pivotally interconnecting a plurality of arms such that said arms are pivotal inwardly and outwardly with respect to each other;

providing a pencil receiving aperture through said plurality of arms with a variable sized opening therethrough, said variable size opening varying in size due to movement of said plurality of arms pivotally inwardly and outwardly;

mounting a cutting blade to at least one of said plurality of arms; and forming a gripping surface on said plurality of arms for gripping said pencil when said plurality of arms are moved pivotally away from each other to support said pencil sharpener in an axial position along a length of said pencil.

20. A pencil sharpener mountable about a pencil, said pencil having an end for sharpening, said pencil sharpener comprising:

a body defining an inlet and an outlet aperture for receiving a pencil for sharpening;

a cutting surface joined to said body;

said body defining a cuttings outlet between said inlet and said outlet aperatures therein for cuttings formed during sharpening of said pencil;

and said body adapted for mounting said pencil sharpener to an axial position at any position along an axial length of said pencil.

21. The pencil sharpener of claim 20, further comprising:

an axial position gripping surface, said axial position gripping surface being engageable with said pencil for affixing said pencil sharpener to an axial position at any position along an axial length of said pencil.

22. The pencil sharpener of claim 21, wherein said axial position gripping surface comprises a grommet.

* * * * *